US008099037B2

(12) United States Patent
Sekine et al.

(10) Patent No.: US 8,099,037 B2
(45) Date of Patent: Jan. 17, 2012

(54) IMAGE FORMING APPARATUS

(75) Inventors: Tetsu Sekine, Sagamihara (JP); Satoshi Ogata, Hachioji (JP); Yujiro Ishida, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 998 days.

(21) Appl. No.: 12/015,090

(22) Filed: Jan. 16, 2008

(65) Prior Publication Data

US 2008/0232878 A1 Sep. 25, 2008

(30) Foreign Application Priority Data

Mar. 20, 2007 (JP) ..... 2007-071864

(51) Int. Cl.
*G03G 15/00* (2006.01)

(52) U.S. Cl. ..... 399/395; 271/228

(58) Field of Classification Search ..... 271/228; 400/579; 399/395

See application file for complete search history.

(56) References Cited

U.S. PATENT DOCUMENTS

| | | | | |
|---|---|---|---|---|
| 5,156,391 | A | 10/1992 | Roller | |
| 5,933,697 | A | 8/1999 | Onodera et al. | |
| 6,619,657 | B2 * | 9/2003 | Horikoshi et al. | 271/188 |
| 7,478,895 | B2 * | 1/2009 | Kralles et al. | 347/20 |
| 7,574,167 | B2 * | 8/2009 | Okamoto et al. | 399/395 |
| 2006/0239733 | A1 | 10/2006 | Choi et al. | |

FOREIGN PATENT DOCUMENTS

| | | | |
|---|---|---|---|
| EP | 0 992 860 | A2 | 4/2000 |
| JP | 59004552 | A * | 1/1984 |
| JP | 63 180635 | | 7/1988 |
| JP | 05201587 | A * | 8/1993 |
| JP | 6-263287 | | 9/1994 |
| JP | 10-212055 | | 8/1998 |
| JP | 2002-249258 | | 9/2002 |
| JP | 2003-146484 | | 5/2003 |
| JP | 2005-200119 | | 7/2005 |

OTHER PUBLICATIONS

European Search Report dated Dec. 7, 2009.

Notice of Reasons for Refusal dated May 17, 2011 from Japanese Patent Office in corresponding Japanese Patent Application No. 2007-071864.

* cited by examiner

*Primary Examiner* — Daniel J Colilla
*Assistant Examiner* — Allister Primo
(74) *Attorney, Agent, or Firm* — Finnegan, Henderson, Farabow, Garrett & Dunner, L.L.P.

(57) ABSTRACT

An image forming apparatus includes: an image forming section which forms an image on a sheet; a conveyance section which conveys the sheet to the image forming section, having a registration roller, a plurality of loop forming rollers which cause the sheet to form a loop, provided upstream of the registration roller in a sheet conveyance direction and arranged in a direction perpendicular to the sheet conveyance direction, a skew detection sensor which detects a skew of the sheet, and a conveyance roller provided upstream of the loop forming roller; and a control section which controls a driving of the conveyance section. The control section controls independently each of the plurality of loop forming rollers based on the detected result of the skew detection sensor.

7 Claims, 6 Drawing Sheets

IMAGE FORMING APPARATUS

This application is based on Japanese Patent Application No. 2007-071864 filed on Mar. 20, 2007, which is incorporated hereinto by reference.

BACKGROUND OF THE INVENTION

The present invention relates to an image forming apparatus for forming an image on a paper sheet.

In the image forming apparatus for forming an image on a paper sheet, in some cases a sheet is conveyed in a state where the sheet skews to a transfer position where an image is transferred to the sheet.

Ideally, the sheet is conveyed to the transfer position in a state in which the leading edge and the trailing edge of the sheet cross orthogonally the conveyance direction and the side edges are parallel to the conveyance direction, but the sheet is sometimes offset from this state and conveyed, and the leading edge reaches the transfer position in a state in which it is inclined with respect to the conveyance direction of the sheet. This phenomenon is called skewing or inclination, and improvements have been done in order to prevent this skewing.

The most widely used technique for preventing skewing is so-called "loop conveyance" using a registration roller. "Loop conveyance" is a technique in which a sheet is conveyed by a loop forming roller, and the sheet is caused to abut the registration roller that has been stopped and by forming a loop upstream of the registration roller, the leading edge of the sheet is caused to cross orthogonally the conveyance direction.

After the loop is formed upstream of the registration roller, conveyance starts and the sheet is conveyed to the conveyance position.

The skew is corrected by this type of loop conveyance, but there is some limit to the skew correction using the registration roller in that loop conveyance is not sufficient in the recent image forming apparatuses that require high accuracy at the image position on the sheet.

In Unexamined Japanese Patent Application Publication Nos. 06-263287 and 10-212055, it has been proposed that each of a plurality of conveyance members arranged in parallel so as to cross orthogonally the sheet conveyance direction, is controlled based on the results from the sheet skew detector.

In Unexamined Japanese Patent Application Publication Nos. 06-263287 and 10-212055, the skew is corrected for two conveyance members that are arranged so as to orthogonally cross the conveyance direction by performing control based on the detection results from the detector.

The techniques of Unexamined Japanese Patent Application Publication Nos. 06-263287 and 10-212055 are effective for sheet skew correction, but insufficient.

In recent times, use of electrophotographic type image forming apparatus has been expanding in the field of short-run printing.

Compared to conventional office applications, printing requires higher image position accuracy and more types of papers are printed and thus there is a tendency for skewing to occur.

For this reason, the conventional techniques in Unexamined Japanese Patent Application Publication No. 06-263287 have become insufficient for preventing skew.

As shown in FIG. 8, in order to evaluate the degree of skew, the proportion of the offset amount $\Delta Y$ in the conveyance direction Y due to a skew of the angle PA of the sheet with respect to the length PX in the direction X which orthogonally crosses the conveyance direction Y of the sheet P, or in other words the skew ratio is $(\Delta Y/PX)\times 100\%$.

The prior art technology is effective for correcting an offset amount of about 1%, but keeping the permissible amount of offset required by recent image forming apparatuses to 0.2% or less is difficult.

SUMMARY OF THE INVENTION

The object of the present invention is to solve the problems of this type of prior art skew prevention technology by providing an image forming device which is capable of forming an image on a sheet with high positional accuracy, and also forming image with high positional accuracy on various types of paper.

The object of the present invention is achieved by the following aspect.

An image forming apparatus is provided with: an image forming section for forming an image on a sheet; a conveyance section for conveying the sheet to the image forming section; a control section for controlling the driving of the conveyance section; and the conveyance section includes a registration roller; a plurality of loop forming rollers for causing the sheet to form a loop, that are arranged on the upstream side in the sheet conveyance direction with respect to the registration roller and in a direction perpendicular to the sheet conveyance direction; a skew detection section for detecting a skew of the conveyed sheet; and a conveyance roller that is provided on the upstream side of the loop forming roller; and the control section independently controls the plurality of loop forming rollers based on the detection results of the skew detection sensor.

DETAILED DESCRIPTION OF THE PREFERRED EMBODIMENT

[Image Forming Apparatus]

Figure 1:
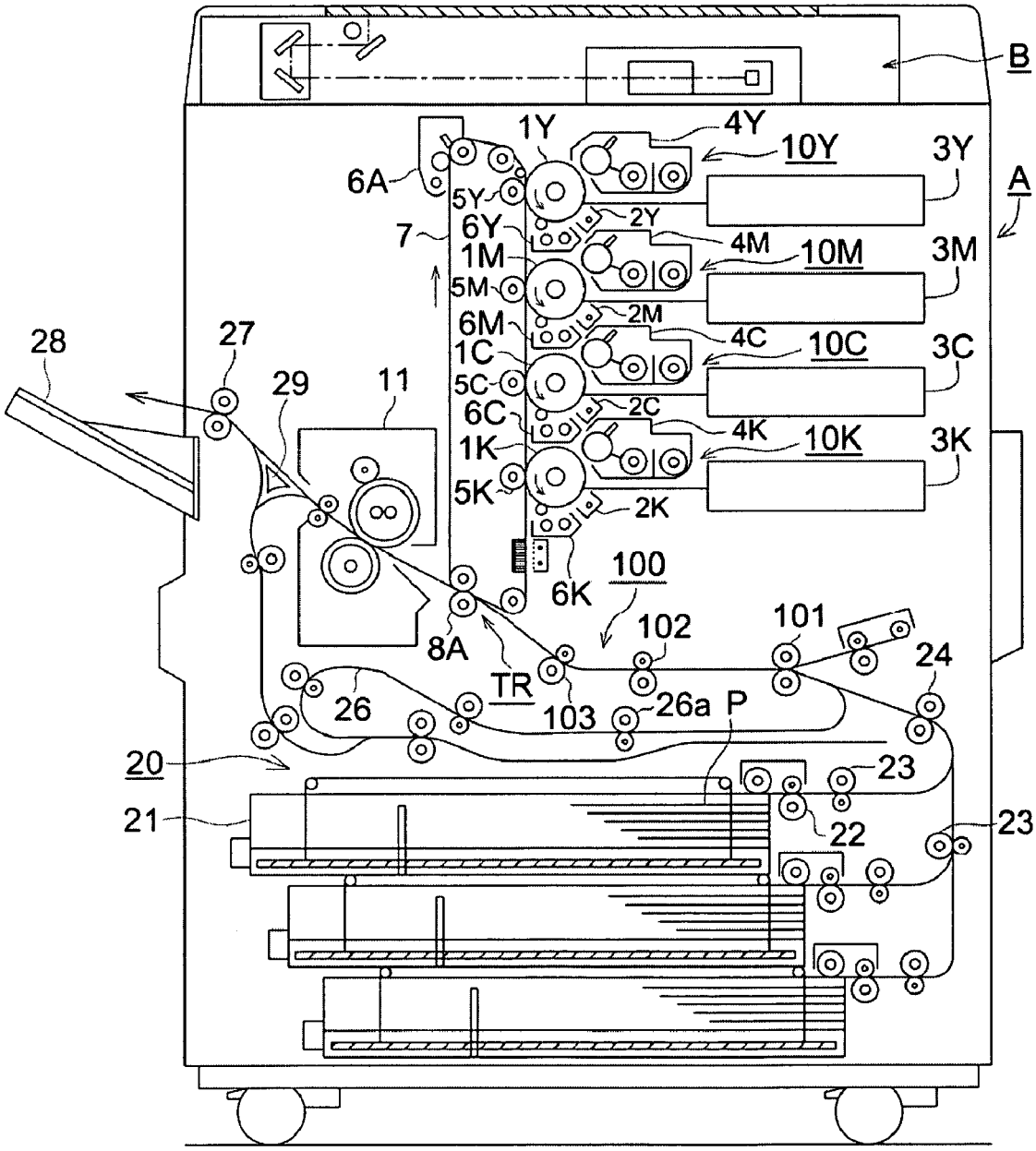
FIG. 1 shows the overall structure of an image forming apparatus of an embodiment of the present invention.

FIG. 1 shows the overall structure of image forming apparatus of the first embodiment of the present invention.

The image forming apparatus shown is called the tandem type color image forming apparatus, and has a plurality of sets of image forming units 10Y, 10M, 10C and 10K; a belt-like intermediate transfer member 7; a conveyance section 100; a sheet storing section 20; re-feeding section 26 and a fixing unit 11. There is a reading device B on top of an image forming section A which is constituted of the image forming units 10Y, 10M, 10C and 10K and the belt-like intermediate transfer member 7.

The image forming unit 10Y for forming yellow toner images has a drum-like photoreceptor 1Y; a charging section 2Y that is disposed at the periphery of the photoreceptor 1Y; an imagewise exposure section 3Y; a developing section 4Y; a primary transfer roller 5Y and a cleaning section 6Y. In addition, the image forming unit 10M for forming magenta toner images has a drum-like photoreceptor 1M; a charging section 2M that is disposed at the periphery of the photoreceptor 1M; an imagewise exposure section 3M; a developing section 4M; a primary transfer roller 5M and a cleaning section 6M. The image forming unit 10C for forming cyan toner images has a drum-like photoreceptor 1C; a charging section 2C that is disposed at the periphery of the photoreceptor 1C; an imagewise exposure section 3C; a developing section 4C; a primary transfer roller SC and a cleaning section 6C. The image forming unit 10K for forming black toner images has a drum-like receptor 1K; a charging section 2K that is disposed at the periphery of the photoreceptor 1K; an imagewise exposure section 3K; a developing section 4K; a primary transfer roller 5K and a cleaning section 6K.

The toner images of each of the colors formed at the image forming units 10Y, 10M, 10C, 10K are successively subjected to primary transfer onto the intermediate transfer member 7 by the primary transfer rollers 5Y, 5M, 5C and 5K and to form a superimposed color toner image.

Sheet P is stored in the sheet cassette 21 of the sheet storage section 20 and one sheet at a time is fed by the sheet feed unit, and the conveyance rollers 23 and 24 convey the sheet to the transfer position TR formed by the secondary transfer roller 8A via the conveyance section 100.

At the transfer position TR, the color toner images are all secondarily transferred to the sheet P. The sheet P on which the color toner image has been transferred is subjected to fixing processing by the fixing device 11 and then nipped by the ejection tray 27 and placed on the ejection tray 28 which is outside the device.

Meanwhile, the intermediate transfer member in which the color toner image has been transferred to the sheet P by the secondary transfer roller 8A is cleaned by the cleaning section 6A and the toner remaining on the surface of the intermediate transfer member 7 is removed.

The primary transfer roller 5K is normally in pressure contact with the photoreceptor 1K during image formation. The other primary transfer rollers 5Y, 5M, and 5C are in pressure contact with the respective corresponding photoreceptor 1Y, 1M and 1C only at the time of color image formation.

The secondary transfer roller 8A is only in pressure contact with the intermediate transfer body 7 when the sheet P passes the transfer position TR and is subjected to secondary transfer.

Numeral 26 is a re-feeding section for rear surface image formation.

Figure 2:
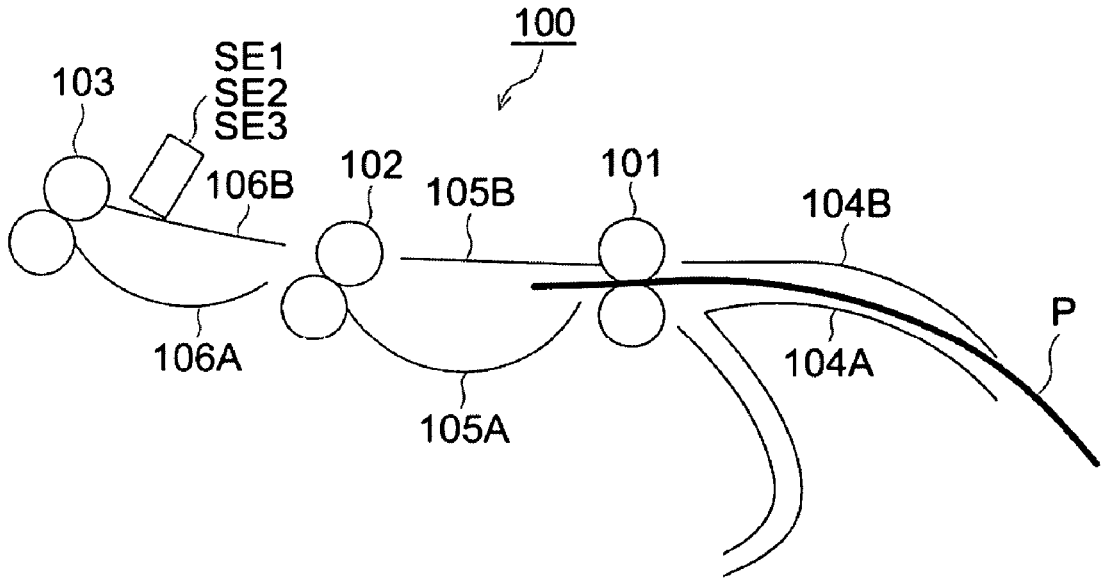
FIG. 2 is a side view of an conveyance section of the image forming apparatus of an embodiment of the present invention.
Figure 3:
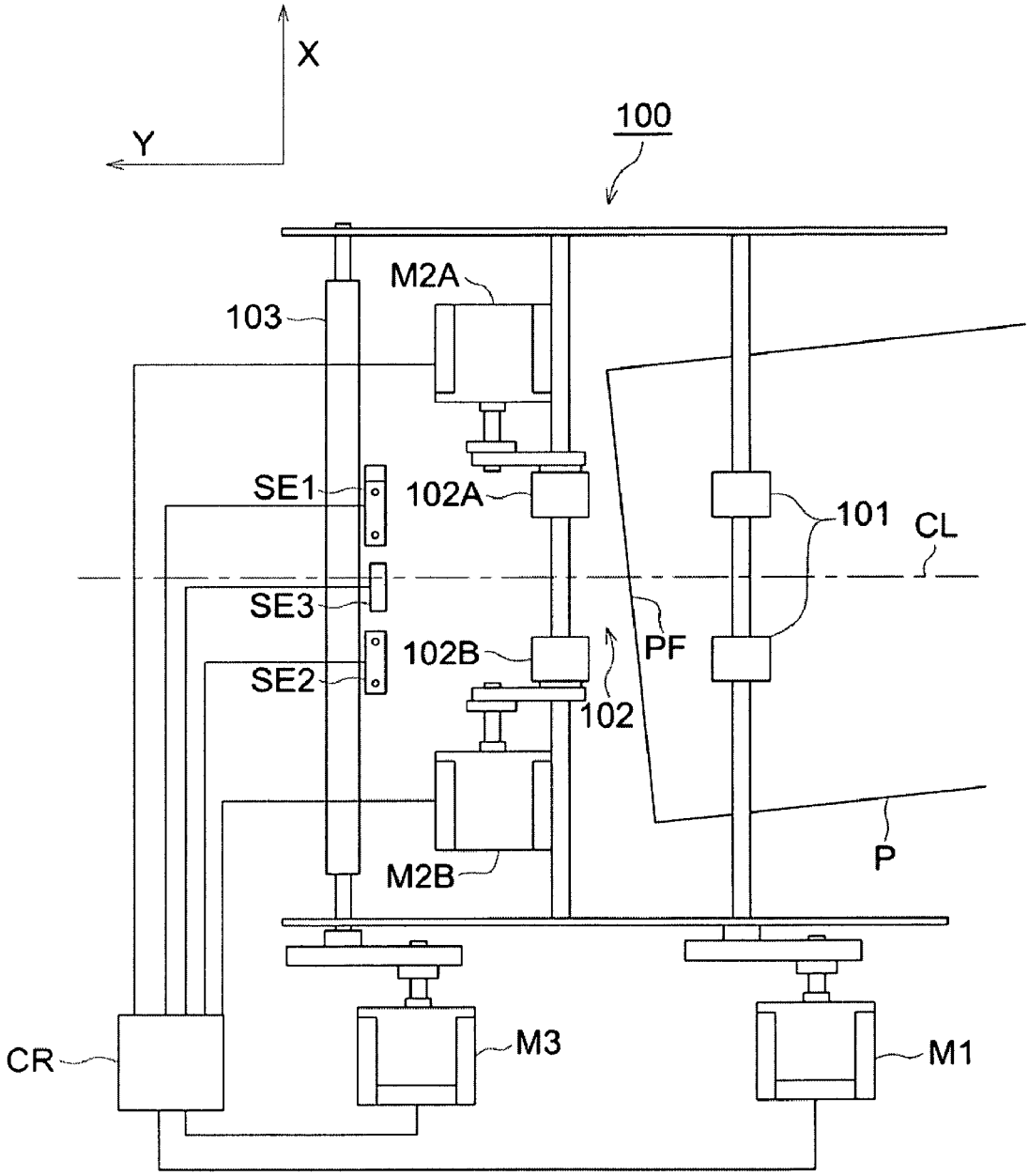
FIG. 3 is a plan view of the conveyance section shown in FIG. 2.

FIG. 2 and FIG. 3 show the conveyance section that supplies sheets to the transfer position TR (See FIG. 1), and FIG. 2 is a lateral section view while FIG. 3 is a plan view.

In the conveyance section 100, the conveyance roller 101, the loop forming roller 102 and the registration roller 103 are arranged sequentially from upstream of the sheet P conveyance direction and the sheet P is thereby conveyed.

In addition, the conveyance section 100 has a guide plate that guides the conveyed sheet and the guide plates 104A and 104B, the guide plates 105A and 105B, and the guide plates 106A and 106B are sequentially arranged from the upstream side.

The lower guide plates 105A and 106A of the guide plates between the conveyance roller 101 and the registration roller 103 are bent in the lower direction and a space for forming a loop on the sheet is formed.

The loop forming roller 102 has a plurality of loop forming roller pairs 102A and 102B that sandwich the center line CL that is in the direction perpendicular to the conveyance direction. The loop forming roller pair 102A is driven by the stepping motor M2A and the loop forming roller pair 102B is driven by the stepping motor M2B.

In addition, the conveyance roller 101 is driven by the stepping motor M1. The registration roller 103 is driven by the stepping motor M3.

The stepping motor M1, M2A, M2B and M3 are controlled by the control section CR.

The sensors SE1 and SE2 are the skew detection sensors that detect skewing of the sheet P. The skew detection sensors SE1 and SE2 are serially arranged so as to sandwich the center line CL and the sheet detection sensor SE3 is arranged on the center line.

It is to be noted that a sensor array in which the sensor elements are arranged in a line may be used as the skew detection sensor and the sensor array is arranged such that the array direction is in the direction that orthogonally crosses the conveyance direction and skew is thereby detected.

By using the sensor array, it becomes possible to detect skew of sheet of different sizes with high accuracy.

The control section CR performs conveyance timing and sheet skew correction in the conveyance section 100.

[Control of Sheet Conveyance Timing]

Figure 4:
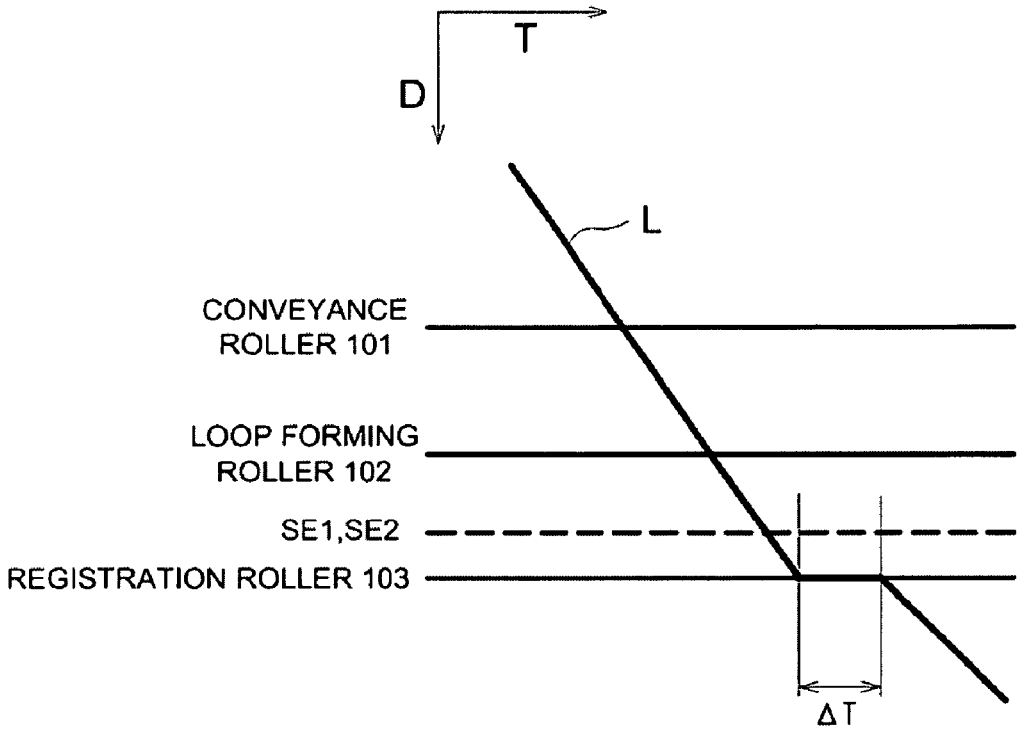
FIG. 4 is a timing chart for describing conveyance timing control.

As shown in FIG. 4, the control section CR controls conveyance timing.

In FIG. 4, the line L shows the conveyance path for the leading edge of the sheet. That is to say, in FIG. 4, the T axis shows the passage of time T and the D axis shows the running distance D of the sheet P.

The sheet P is conveyed by the conveyance roller 101 and runs to the loop roller 102 and then conveyed by the loop forming roller 102 and runs to the register roller 103 and then conveyed again in the direction of the transfer position TR after stop time ΔT at the position of the registration roller 103.

The stop time ΔT is the time for forming the loop on sheet P at the upstream direction of the registration roller 103 and also the time for synchronizing with image formation and determines the relationship with the exposure start time.

That is to say, at the transfer position TR (See FIG. 1), the start timing for conveyance of the registration roller 103 is controlled such that the relationship between leading end of the color toner image on the intermediate transfer member 7 and the leading end of the sheet P always have a fixed relationship.

By providing the stop time ΔT, a loop is formed on the upstream side of the registration roller 103 and because of this loop, a force causing the sheet to return to its original state is generated and skew of the sheet P is corrected.

[Skew Correction 1]

At the position of the dotted line in FIG. 4, the leading edge of the sheet P is detected by the skew detection sensors SE1 and SE2 respectively. The control section CR controls the stepping motor M2A based on the detection signal from the skew detection sensor SE1 and controls the stepping motor M2B based on the detection signal of the sensor SE2.

As shown in FIG. 3, the detection signals of the skew detection sensors SE1 and SE2 that detected conveyed sheet P in a skew state in which the leading edge PF is offset from the direction X that is orthogonal to the conveyance direction Y, are output with timing difference.

The loop forming roller 102 include two loop forming roller pairs 102A and 102B and the control section CR independently controls the stepping motors M2A and M2B and thus the loop forming roller pairs 102A and 102B are driven at different speeds, respectively.

More specifically, in skew correction 1, the correction section CR controls the rotation speed of the stepping motors M2A and M2B respectively in accordance with the time difference of the leading edge detection of the sensors SE1 and SE2.

That is to say, the rotation speed of the motor that drives the loop forming roller pair at the side where detection is earlier is delayed, while the rotation speed of the motor that drives the loop forming roller pair at the side where detection is delayed, is quickened and thereby skew of the sheet is corrected.

A sheet detection sensor SE3 for detecting the leading edge of the sheet is disposed on the upstream side of the registration roller 103.

The loop forming roller pairs 102A and 102B are stopped after a prescribed time after the sheet detection sensor SE3 detects the leading edge of the sheet.

The stopping timing of the loop forming roller pairs 102A and 102B is set such that a loop is formed on the sheet P, upstream with respect to the registration roller 103.

The skew of the sheet P is further corrected by loop formation on the upstream side of the registration roller 103.

After a prescribed amount of loop formation on the upstream side of the registration roller 103, the registration roller 103 is started up and the sheet P is conveyed towards the transfer position TR.

[Skew Correction 2]

In skew correction 2, the control section CR independently controls the loop forming roller pair 102A and 102B which form the loop forming roller 102 and also controls stop timing of the loop forming roller pair 102A and 102B.

Figure 5:
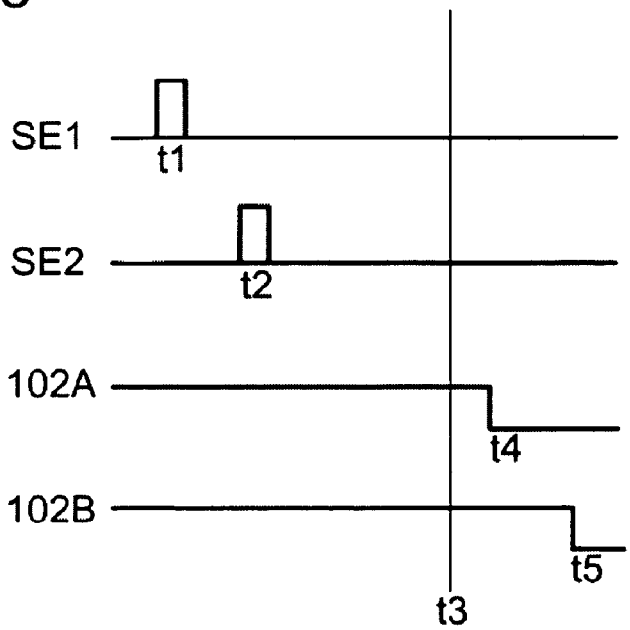
FIG. 5 is a timing chart for describing skew correction 2.

Control in skew correction 2 is described using FIG. 5 as follows.

The control section CR controls the conveyance speed of the loop forming pair 102A and the loop forming pair 102B so as to be equal to each other.

The leading edge of the sheet P is detected by the skew detection sensor SE1 at time t1 and the leading edge of the sheet P is detected by the skew detection sensor SE2 at time t2.

The control section CR continues driving of the loop forming roller pair 102A and 102B after leading edge detection and the loop forming roller pair 102A is stopped at time t4 and the loop forming roller pair 102B is stopped at time t5.

Because (t4−t1)=(t5−t2), the running distance of the sheet P from the detection positions of the skew detection sensor SE1 and SE2 becomes the same between both ends in the direction which orthogonally crosses the conveyance direction and the skew is corrected.

It is to be noted that the time from leading edge detection by the skew detection sensors SE1 and SE2 to when they stop, may be set to a suitable value obtained by experiments.

The leading edge of the sheet P reaches the registration roller 103 at time t3 which is before the stop time t4 of the loop forming roller pair 102A and 102B and during time t3−t4, a loop is formed on the sheet P on the upstream side of the registration roller 103.

The leading edge of the sheet P abuts the nip of the registration roller 103 and stops and by the loop being formed, parallelism with respect to the direction X of the leading edge is further increased, and skew correction can be done with high accuracy.

[Tension Correction 1]

In the skew correction described above, the sheet P is conveyed by the conveyance roller 101 upstream of the loop forming roller 102.

Thus, in the case where the direction of the sheet P is changed in skew correction due to independent control of the roller pair 102A and 102B constituting the loop forming roller 102, there is a difference in the conveyance distance of both ends of the sheet P between the conveyance roller 101 and the loop roller 102 in direction X, that is the direction which orthogonally crosses the conveyance direction (width direction).

Due to this difference in the conveyance distance, a bias occurs in the tension of the sheet P between both ends in the width direction of the sheet P. The tension bias causes problems in that the desired skew correction is incorrect and crease is generated on the sheet.

In the present embodiment, this problem is solved by performing tension correction control which removes the tension on the sheet P upstream of the loop forming roller 102.

In tension correction 1, a correction loop is formed on the sheet P by the conveyance roller on the upstream side of the loop forming roller 102.

By formation of the correction loop, the difference in the conveyance distance at both ends of sheet P is absorbed and the tension bias is removed.

The correction loop is formed by setting the conveyance speed of the conveyance roller 101 to be faster than the conveyance speed of the loop forming roller 102. That is, after the leading edge of the sheet P reaches the loop forming roller 102, the conveying roller 101 conveys the sheet P at a faster speed than the loop forming roller 102, and thus a correction loop is immediately formed upstream of the loop forming roller 102. It is to be noted that in skew correction, in the case where the conveyance speeds of the loop forming roller pair 102A and 102B are different, the conveyance speed of the conveyance roller 101 is made faster than the conveyance speed of one of the loop forming roller pair 102A and 102B.

In this manner, skew correction by independent control of the loop forming roller pair 102A and 102B is performed sufficiently.

[Tension Correction 2]

Figure 6:
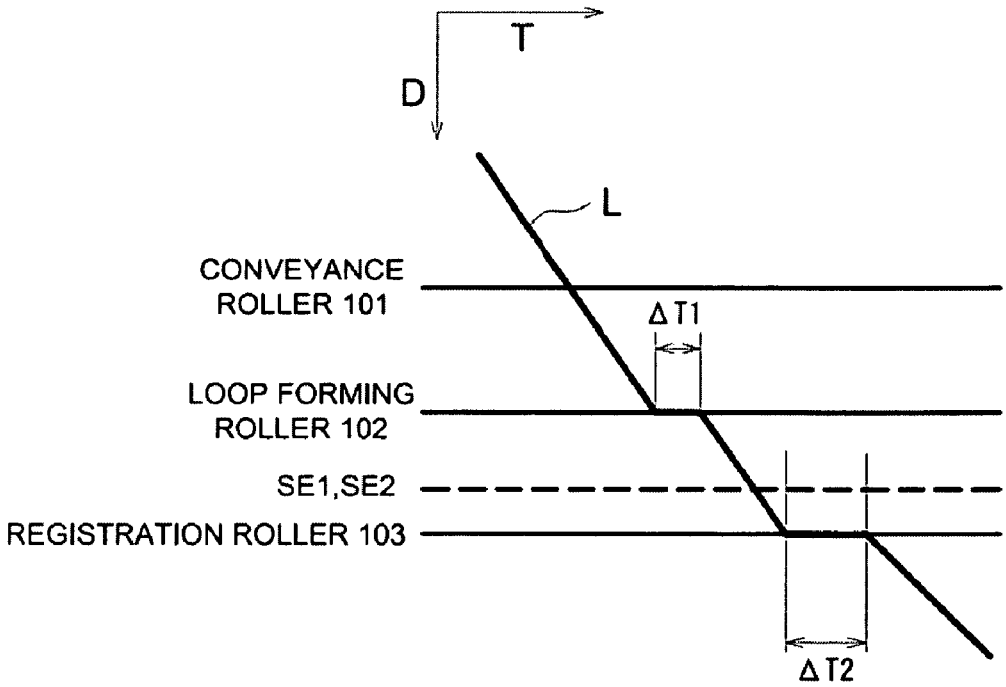
FIG. 6 is a timing chart for describing tension correction 2.

FIG. 6 shows the timing chart for sheet conveyance in tension correction 2.

The sheet is conveyed by the conveyance roller 101 and it abuts the loop forming roller 102 that has stopped and then is conveyed by the loop forming roller 102 after stopping for time ΔT1, then abuts the registration roller 103 that has stopped.

After ΔT2, the registration roller 103 starts up and conveyance begins.

The conveyance speed by the conveyance roller 101 is equal to the conveyance speed of the registration roller 103.

Because the correction loop is formed upstream of the loop forming roller 102 due to the stop time ΔT1, as described above, the tension bias generated by independently controlling the conveyance roller pair 102A and 102B for tension correction is removed.

[Tension Correction 3]

Figure 7:
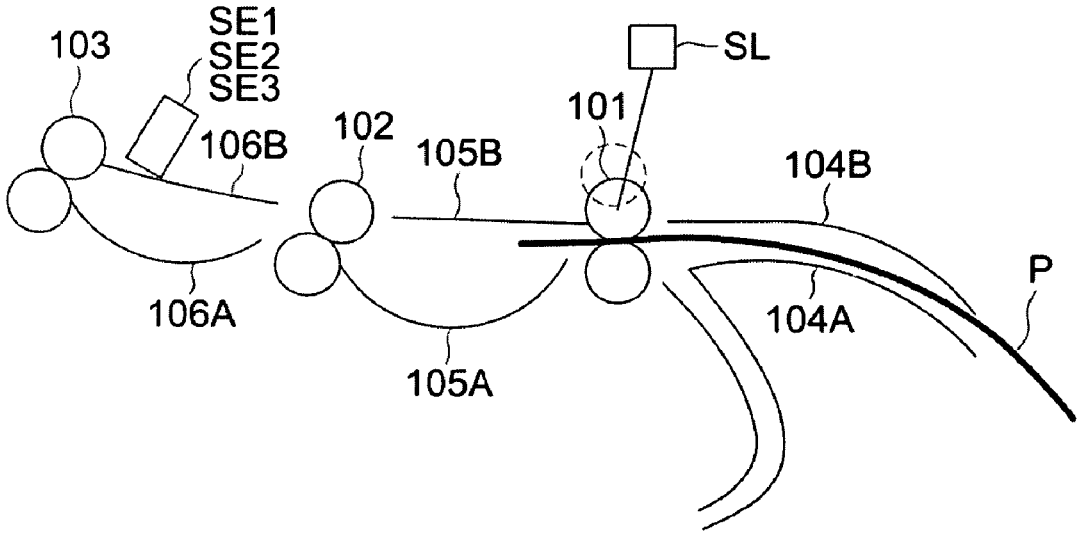
FIG. 7 shows the tension correction section for performing tension correction 3.
Figure 8:
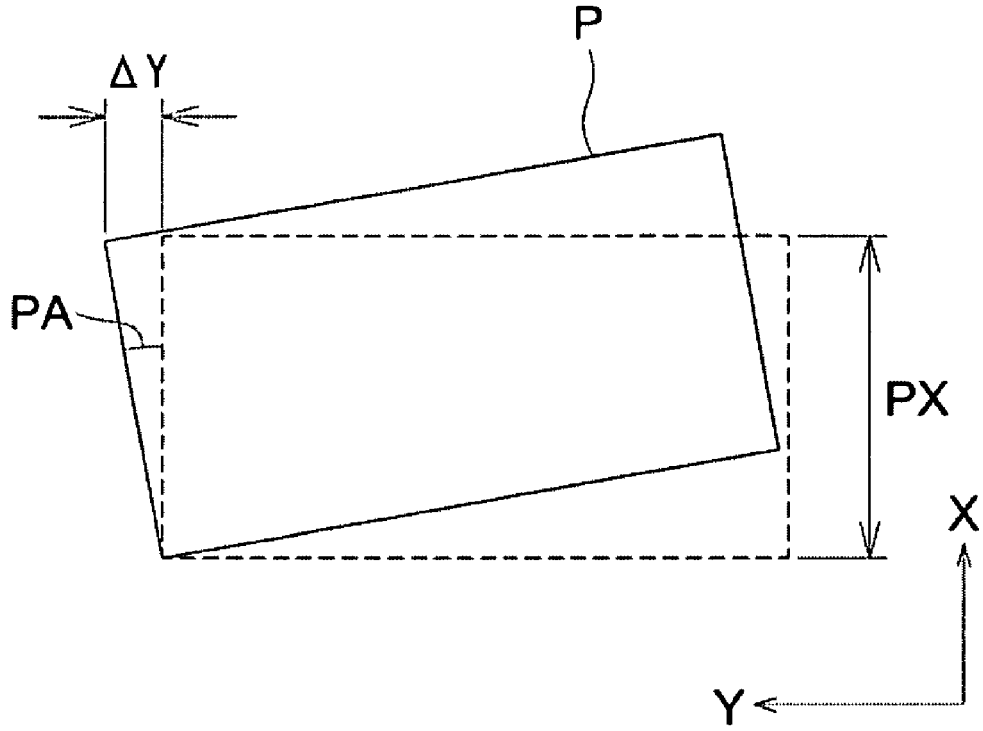
FIG. 8 is a view for describing a sheet skew.

FIG. 7 shows tension correction 3.

The conveyance roller 101 is formed such that the nip of the roller pair constituting the conveyance roller 101 can be released by a solenoid SL.

The control section CR operates the solenoid SL based on the signal that the skew detection sensor SE1 or SE2 detected the leading edge of sheet P and the nip of the conveyance roller 101 is released.

As a result, only the conveyance force due to the loop forming roller pair 102A and 102B which forms the loop forming roller 102 acts on the sheet P and in the case where the loop forming roller pair 102A and 102B are independently controlled, no tension bias is generated on the sheet P.

It is to be noted that there are other conveyance rollers upstream of the conveyance roller 101, but they are positioned further upstream than the loop forming roller 102 and the nip of all the conveyance rollers that nip sheets at the same time as the loop forming roller pair 102A and 102B and performs conveyance, is released.

In the example of FIG. 1, a nip release mechanism is provided at the conveyance rollers 23 and 24 provided in the conveyance section between the sheet storage section 20 and the conveyance section 100 and at the conveyance roller 26a that is provided at the re-feeding section 26.

The configuration may be such that the nip release state of the conveyed roller continues before the next sheet is conveyed, and during conveyance of the next sheet, the nip state is returned, but at the point where skew correction ends, or in other words, at the starting point of sheet conveyance by the registration roller 103, the nip state is returned.

In this embodiment, when skew correction is done by independently controlling a plurality of loop forming rollers, by forming a loop for correcting tension bias generated on the sheet using the upstream side conveyance rollers, and thus skew correction is done with high accuracy. In addition, skew correction with high accuracy can be done for various types of sheet.

What is claimed is:

1. An image forming apparatus comprising:

(a) an image forming section which forms an image on a sheet;

(b) a conveyance section which conveys the sheet to the image forming section, comprising (1) a registration roller, (2) a plurality of loop forming rollers which cause the sheet to form a first loop, provided upstream of the registration roller in a sheet conveyance direction and arranged in a direction perpendicular to the sheet conveyance direction, (3) a skew detection sensor which detects a skew of the sheet, and (4) a conveyance roller which corrects a tension of the sheet between the plurality of loop forming rollers and the conveyance roller, provided upstream of the loop forming rollers, and (c) a control section which controls a driving of the conveyance section, wherein the control section controls independently each of the plurality of loop forming rollers based on a detected result of the skew detection sensor, and wherein the control section drives the conveyance roller and the plurality of loop forming rollers so that the sheet hits the plurality of loop forming rollers that are stopped, thereby a second loop which corrects the tension of the sheet between the plurality of loop forming rollers and the conveyance roller is formed on the sheet between the plurality of loop forming rollers and the conveyance roller, and the sheet hits the registration roller that is stopped, thereby the sheet is caused to form the first loop between the registration roller and the plurality of loop forming rollers.

2. The image forming apparatus of claim 1, wherein the control section drives each of the plurality of loop forming rollers at a conveyance speed different from each other based on the detected result detected by the skew detection sensor.

3. The image forming apparatus of claim 1, wherein the control section controls a stop period of time of each of the plurality of loop forming rollers based on a detected result of a leading edge of the sheet by the skew detection sensor.

4. The image forming apparatus of claim 1, wherein the control section drives the conveyance roller at a conveyance speed faster than that of the plurality of loop forming rollers, thereby the second loop which corrects the tension of the sheet between the plurality of loop forming rollers and the conveyance roller, is formed on the sheet between the conveyance roller and the plurality of loop forming rollers.

5. The image forming apparatus of claim 1, wherein the control section releases a nip of the roller pair consisting the conveyance roller when a skew correction by the plurality of loop forming rollers is carried out.

6. The image forming apparatus of claim 1, wherein the skew detection sensor comprises a plurality of skew detection sensors which are disposed in the direction perpendicular to the sheet conveyance direction.

7. The image forming apparatus of claim 1, wherein the skew detection sensor comprises a sensor array in which a plurality of detection elements are arranged in the direction perpendicular to the sheet conveyance direction.

* * * * *